US010035691B2

(12) United States Patent
Malmberg et al.

(10) Patent No.: US 10,035,691 B2
(45) Date of Patent: Jul. 31, 2018

(54) METHOD FOR A FILLING VALVE, AND A FILLING VALVE SYSTEM

(71) Applicant: TETRA LAVAL HOLDINGS & FINANCE S.A., Pully (CH)

(72) Inventors: Stefan Malmberg, Klågerup (SE); Jimmy Magnusson, Åkarp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 99 days.

(21) Appl. No.: 15/028,799

(22) PCT Filed: Sep. 25, 2014

(86) PCT No.: PCT/EP2014/070462
§ 371 (c)(1),
(2) Date: Apr. 12, 2016

(87) PCT Pub. No.: WO2015/055397
PCT Pub. Date: Apr. 23, 2015

(65) Prior Publication Data

US 2016/0264392 A1 Sep. 15, 2016

(30) Foreign Application Priority Data

Oct. 18, 2013 (SE) ..... 1351242

(51) Int. Cl.
*B67C 3/28* (2006.01)
*B65B 3/26* (2006.01)
(Continued)

(52) U.S. Cl.
CPC ..... *B67C 3/283* (2013.01); *B65B 3/26* (2013.01); *B67C 3/2614* (2013.01); *B67C 3/287* (2013.01); *B67C 2003/228* (2013.01)

(58) Field of Classification Search
CPC ..... B67C 3/283; B67C 3/287; B65B 3/30
(Continued)

(56) References Cited

U.S. PATENT DOCUMENTS 4,557,301 A * 12/1985 Jorss ..... B65B 3/26 141/102
4,890,774 A * 1/1990 Poore ..... B67D 1/1213 141/102
(Continued)

FOREIGN PATENT DOCUMENTS

DE 10 2008 030 292 A1 12/2009
JP 2-191193 A 7/1990
(Continued)

OTHER PUBLICATIONS

International Search Report (PCT/ISA/210) dated Jan. 8, 2015, by the European Patent Office as the International Searching Authority for International Application No. PCT/EP2014/070462.
(Continued)

*Primary Examiner* — Timothy L Maust
(74) *Attorney, Agent, or Firm* — Buchanan Ingersoll & Rooney PC

(57) ABSTRACT

A filling valve system configured to discharge a predetermined volume of liquid product to individual packages is provided. The system comprises at least one filling valve; a controller configured to open the at least one filling valve thus allowing liquid product to be discharged and configured to close the at least one filling valve; and a flow meter configured to measure the amount of liquid product being discharged through the at least one filling valve. The system further comprises a pressure sensor configured to determine a pressure upstream of the at least one filling valve, wherein the controller is further configured to calculate an estimated discharge volume during a closing sequence of the at least one filling valve based on the determined pressure, and to
(Continued)

initiate the closing sequence based on the estimated discharge volume.

14 Claims, 3 Drawing Sheets

(51) Int. Cl.
*B67C 3/26* (2006.01)
*B67C 3/22* (2006.01)

(58) Field of Classification Search
USPC ..... 141/2, 94, 95, 102, 144–147
See application file for complete search history.

(56) References Cited

U.S. PATENT DOCUMENTS 5,515,888 A * 5/1996 Graffin ..... B65B 3/28 141/1
5,823,234 A * 10/1998 Boertz ..... B67C 3/20 141/1
5,839,483 A * 11/1998 Rejret ..... B67D 1/0006 141/1
6,729,366 B2 * 5/2004 Tanaka ..... B67C 3/007 141/144
6,761,191 B2 * 7/2004 Rosen ..... B67C 3/001 134/168 C
6,779,569 B1 * 8/2004 Teer, Jr. ..... B63B 25/082 141/198
8,701,722 B2 * 4/2014 Clusserath ..... B67C 3/02 141/100
8,985,161 B2 * 3/2015 Lorenz ..... B65B 3/34 141/1
9,010,387 B2 * 4/2015 Meinzinger ..... B67C 3/287 141/144

FOREIGN PATENT DOCUMENTS

JP 9-002585 A 1/1997
JP 2009-190770 A 8/2009
WO WO 2008/078174 A2 7/2008

OTHER PUBLICATIONS

Written Opinion (PCT/ISA/237) dated Jan. 8, 2015, by the European Patent Office as the International Searching Authority for International Application No. PCT/EP2014/070462.

* cited by examiner

METHOD FOR A FILLING VALVE, AND A FILLING VALVE SYSTEM

TECHNICAL FIELD

The present invention relates to a method for a filling valve, and a filling valve system. More particularly, the present invention relates to a method and system for which a filling valve is configured to discharge a predetermined volume of liquid from a liquid product supply.

BACKGROUND

In the filling industry and in particular the industry dealing with filling of liquid products into individual packages, it is desirable to provide accurate control of the actual volume of liquid product being filled. For this it has proven to be efficient to make use of filling valves wherein a control command allows opening of the valve. Hence, liquid product is discharged and a closing command makes sure that the filling valve is closed when a predetermined volume has been discharged.

Filling valves provide a number of advantages with regards to e.g. availability, controlling, and compactness. However it is necessary to accurately determine the performance of the filling valves in order to control the operation. Since opening and closing is performed by moving a valve member between two positions there will be some discharging during these moving sequences whereby a certain amount of liquid will be allowed to escape through the filling valve and thus such volume will contribute to the total volume being discharged.

In order to accurately control the operation of the filling valves a flow meter may be provided, which flow meters are configured to transmit a pulse each time a predetermined volume passes an associated flow meter. By counting the number of pulses from the flow meter it is possible to determine the accumulated volume passing through the flow meter. Hence, once the filling valve is commanded to open the flow meter will start to measure the volume being discharged. When a certain volume has been discharged the filling valve will be commanded to close whereby a controller assumes an additional volume to be added to the discharged volume due to the delay in the closing operation of the filling valve. However, should the actual closing operation of the filling valve differ from the assumed operation for some reason the total volume of discharged liquid will deviate from the desired volume. This provides a drawback for the filling operator since the individual packages may contain too much or too less liquid if the closing operation of the filling valve is affected in some way.

Hence, it is necessary to provide a method for a filling valve, as well as a filling valve system, resulting in a more accurate control of the filling valves.

SUMMARY

It is, therefore, an object of the present invention to overcome or alleviate the above described problems.

An idea of the present invention is to provide a filling valve system, wherein closing of the filling valves is controlled depending on a pressure upstream of the filling valves.

According to a first aspect.a filling valve system configured to discharge a predetermined volume of liquid product to individual packages is provided. The system comprises at least one filling valve; a controller configured to open said at least one filling valve thus allowing liquid product to be discharged and configured to close said at least one filling valve; and a flow meter configured to measure the amount of liquid product being discharged through said at least one filling valve. The system further comprises a pressure sensor configured to determine a pressure upstream of said at least one filling valve, wherein said controller is further configured to calculate an estimated discharge volume during a closing sequence of said at least one filling valve based on the determined pressure, and to initiate said closing sequence based on said estimated discharge volume. As the flow speed through the filling valve has proven to be affected by the upstream pressure the discharge volume during the closing sequence will vary depending on the upstream pressure. Hence, the closing sequence may be initiated when the accumulated discharge volume equals the desired volume minus the estimated discharge volume.

The controller may be configured to compare the determined pressure with a reference pressure for determining a pressure difference, and wherein the estimated discharge volume is calculated based on said pressure difference. It is thus possible to estimate a discharge volume during the closing sequence accurately, also in such cases where it may be necessary to adjust the reference pressure due to system operation.

The system may further comprise a gas system in fluid connection with a liquid product tank, which liquid product tank is arranged in fluid connection with said at least one filling valve. The provision of a gas system allows for a controlled environment inside the liquid product tank.

Further, the pressure sensor may be arranged inside said liquid product tank and configured to determine a gaseous pressure inside said liquid product tank. Hence, in case the gaseous pressure varies this will not affect the discharge volume since the closing sequence is controlled as a function of the gaseous pressure inside the liquid product tank.

During production, the gas system may be in fluid connection with an area adjacent to the at least one filling valve for providing a gaseous environment at said area. The presence of microorganisms or other unwanted substances may thus be reduced, whereby the quality of the liquid product as well as the package enclosing it may be improved.

The at least one filling valve may comprise a first set of filling valves associated with a first filling line and a second set of filling valves associated with a second filling line, wherein each one of said sets of filling valves is configured to be in an active state or in a non-active state independent of each other, and wherein said gas system is providing a gaseous environment only to the set of filling valves being in an active state. This is advantageous in that the actual amount of gas may be directed only at the area where it is needed, without affecting the accuracy of the discharged filling volume since the closing sequence of the filling valves will be initiated based on the gaseous pressure inside the liquid product tank.

The gas system may comprise a supply of air or nitrogen gas.

According to a further aspect, a filling machine for filling liquid products into individual packages is provided. The filling machine comprises a filling valve system according to the first aspect.

The filling valve system may be arranged in an aseptic area of said filling machine.

According to a yet further aspect, a method for a filling valve being configured to discharge a predetermined volume of liquid product to individual packages is provided. The method comprises the steps of: controlling the opening of the filling valve for allowing liquid product discharge at a starting time, measuring the amount of liquid being discharged through the filling valve, and controlling the closing of the filling valve. The step of controlling the closing of the filling valve is performed by i) determining a pressure upstream of said filling valve, ii) calculating an estimated discharge volume during a closing sequence of the filling valve based on said determined pressure, and iii) initiating a closing sequence based on said estimated discharge volume.

The step of controlling the closing of the filling valve may further comprise comparing said determined pressure with a reference pressure for determining a pressure difference, and wherein said estimated discharge volume is calculated based on said pressure difference.

Further, the step of determining the pressure upstream of the filling valve may comprise determining the pressure in a liquid product tank being in fluid connection with said filling valve.

BRIEF DESCRIPTION OF DRAWINGS

The above, as well as additional objects, features, and advantages of the present invention, will be better understood through the following illustrative and non-limiting detailed description of preferred embodiments of the present invention, with reference to the appended drawings, wherein.

DETAILED DESCRIPTION

Figure 1:
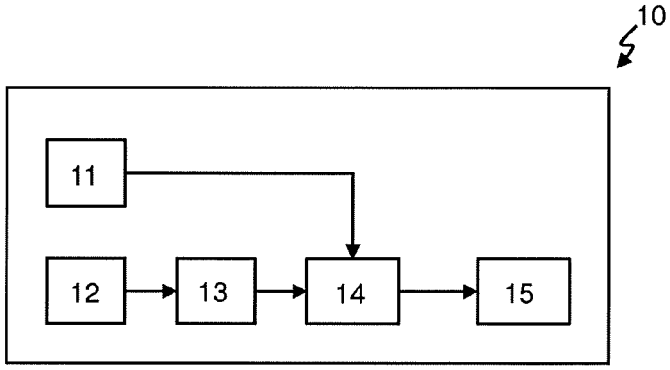
FIG. 1 is a schematic view of a filling machine using a filling valve system according to different embodiments.

Starting with FIG. 1 a schematic view of a filling machine is illustrated. The filling machine 10 is preferably configured to fill liquid products into individual packages, and include a liquid product inlet 11 and a supply 12 of packaging material. The packaging material may e.g. be semi-finished containers like open ended PET-bottles, glass containers etc, although in a preferred embodiment the packaging material is a carton-based material used within liquid food industry, either in the form of a packaging material web or as separate blanks. The packaging material is preferably fed into a sterilizing unit 13 in order to reduce the presence of microbiological substances and other harmful microorganisms. The filling machine 10 further comprises a filling unit 14 in which liquid product is allowed to enter individual packages. In case the packaging material is supplied as a carton based material, the filling unit 14 is further configured to form such packaging material into individual packages and to seal them accordingly. For example, the filling unit 14 may be configured to perform a number of subsequent steps, such as i) provide a semi-finished carton-based package, ii) fill such semi-finished package with liquid product, and iii) seal the filled package such that the package is completely closed.

In a preferred embodiment the filling unit 14 receives blanks of carton-based material and forms them into open-ended tubes or sleeves, whereby a closed top of plastic material is injection molded directly onto the tube for closing one end. The other end, which will later form the bottom end of the package, is subsequently aligned with a filling valve of the filling unit for receiving liquid product. When a predetermined volume of liquid product is received, the filling unit 14 seals the yet open end for completely sealing the package. The closed package is thereafter received in a distribution unit 15, wherein several subsequent packages are collected and forwarded to further handling and distribution.

As the packaging material is sterilized when entering the filling unit 14 it is advantageous to arrange the filling unit 14 in an aseptic environment. This may e.g. be achieved by providing an over pressure of sterilized gas in the filling area, which over pressure is maintained until the packages are completely filled and sealed.

Figure 2:
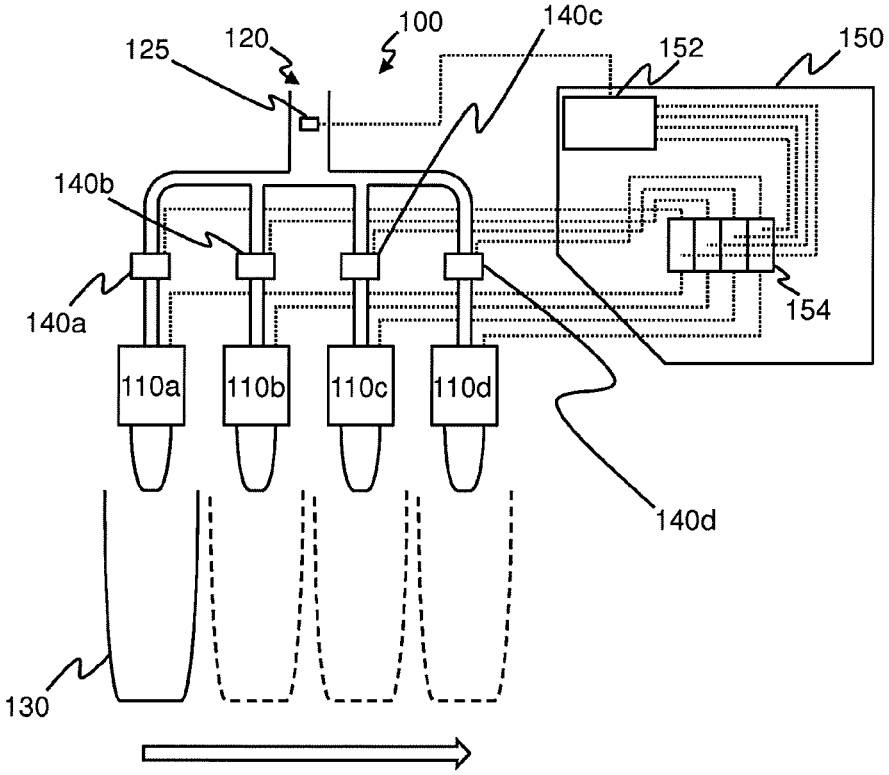
FIG. 2 is a schematic view of a filling valve system according to an embodiment.

Now turning to FIG. 2 an example of a filling valve system 100 is shown. The filling valve system 100 may be used with various different filling machines as will be described below and in particular for applications requiring high accuracy in filling volume control. Such applications may e.g. include expensive liquid products such as chemicals, pharmaceuticals, cosmetics, etc, but may also include liquid products for which the consumer expects a high accuracy, such as for liquid food products like milk, still drinks, juices, etc.

The filling valve system 100 comprises at least one filling valve 110 which is in fluid connection with a liquid product supply 120. As can be seen in FIG. 2 four filling valves 110*a-d* are provided in parallel, wherein each one of said filling valves 110*a-d* are in fluid connection with the liquid product supply 120.

The filling valve system 100 is arranged in line with a feed unit for semi-finished packages 130. As illustrated in FIG. 2 an empty package is received from the left end of the drawing and moves in vertical alignment with the first filling valve 110*a*. After partial filling the package is transported and aligned with the second filling valve 110*b* for an additional partial filling. The package 130 then moves across the third and the fourth filling valves 110*c*, 110*d* before the package 130 is completely filled. Having several filling valves 110*a-d* operated in sequence provides a number of advantages. Firstly, dividing the filling procedure into several steps allows the movement of the packages 130 to be adapted to previous and subsequent indexing and movement of the filling machine of which the filling valve system 100 forms part. Secondly, each filling valve 110*a-d* may be optimized according to its index position. For example, the first filling valve 110*a* will provide a first volume of liquid product in an empty package whereby a fast filling may result in excessive foam formation and splatter. The first filling valve 110*a* may therefore be provided to perform a relatively slow filling with a specific distribution of the outlet liquid product such that the liquid product hits the interior walls of the package. Consequently, the subsequent filling valves 110*b-d* may be configured to provide a faster filling thereby allowing other configurations of the nozzles of the filling valves 110*b-d*.

In a preferred embodiment there is a constant supply of packages 130, such that when a first package leaves the first filling valve 110*a* a subsequent package 130 is aligned with the first filling valve 110*a* as the first package 130 moves to the second filling valve 110*b*. All of the filling valves 110*a-d* may thus be operated at the same time such that each one of the filling valves 110*a-d* provides a partial filling of a package 130.

In order to control the volume being discharged from the filling valves 110*a-d* each filling valve 110*a-d* is associated with a unique flow meter 140*a-d*. Hence, each filling valve 110*a-d* is arranged at the end of a corresponding fluid channel, wherein each fluid channel is branched off from the liquid product supply 120. The flow meters 140*a-d* are arranged at each fluid channel such that each flow meter 140*a-d* only measures the volume of liquid product being discharged from a single filling valve 110*a-d*.

Each filling valve 110*a-d* and each flow meter 140*a-d* are connected to a controller 150. The controller 150 is configured to transmit commands for opening and closing the filling valves 110*a-d*. The controller 150 is further configured to receive data corresponding to the position of the packages 130, such that opening and closing of the filling valves 110*a-d* only occur when a package 130 is aligned with the respective filling valve(s) 110*a-d*. For this purpose, the controller 150 comprises a central processing unit 152 as well as a high speed counter 154, which will further be described below.

When a package 130 is moving into a position in which it is aligned with the first filling valve 110*a* the controller 150 transmits a command to the first filling valve 110*a* to begin opening. As soon as the liquid product is discharged from the first filling valve 110*a* the associated flow meter 140*a* begins measuring the discharged volume and transmits associated data to the high speed counter 154. When the number of flow meter pulses reaches a predetermined value being stored in the central processing unit 152, thus corresponding to an accumulated discharge volume, the high speed counter 154 transmits a closing command to the first filling valve 110*a* whereby the valve 110*a* begins a closing sequence. The first flow meter 140*a* continues measuring the discharged volume during closing such that the high speed counter 154 receives accurate values of the total discharged volume. The same sequence is applied to the second, third, and fourth filling valve 110*b-d*.

Hence, as the flow meters 140*a-d* measures the liquid flow continuously the high speed counter 154 will receive a series of pulses. For this, the high speed counter 154 may comprise a specific channel for each flow meter 140*a-d* such that the high speed counter 154 may measure the number of pulses for each flow meter 140*a-d* simultaneously. The central processing unit 152 controls the closing sequence by commanding the high speed counter 154 to initiate closing when the number of measured pulses reaches a predetermined number. Thus, each channel of the high speed counter 154 receives data from an associated flow meter 140 as well as by the central processing unit 152. Further, each channel of the high speed counter 154 is connected to an associated filling valve 110*a-d* for commanding closing of the filling valve 110*a-d*.

The filling valves 110*a-d* operate by moving a valve member between an open and a closed position. Typically, such movement is implemented by controlling a servo motor which is connected to the valve member. The opening and closing movement of such valve members is not abrupt, but as soon as the valve begins to open there will be an increase of liquid product flow until the valve is completely open. The same applies for the closing sequence, whereby the flow will decrease until the valve is completely closed. This is illustrated in FIG. 3, showing a diagram of the fill speed, i.e. the flow through the filling valve 110*a-d*, as a function of time.

At T1 the controller 150 transmits an opening command to the filling valve 110. The filling valve 110 thus begins opening, whereby the fill speed is increasing until the valve is completely open at T2. The valve is left open until T3 when the controller 150 transmits a closing command to the filling valve 110*a-d* via the high speed counter 154. Hence, T3 corresponds to a predetermined number of flow meter pulses being measured by the high speed counter 154, Upon this the valve starts to close and the fill speed is decreasing until the valve is completely closed. This process is repeated, in series and/or in parallel, for all filling valves 110*a-d* and for all packages 130.

Figure 3:
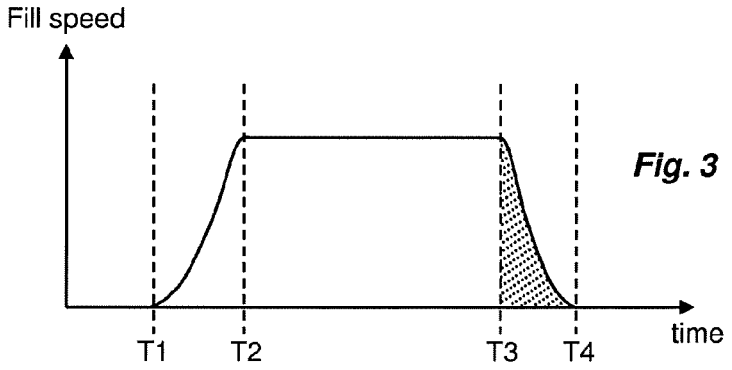
FIG. 3 is a diagram illustrating the filling sequence of a filling valve.

The total volume being discharged from the filling valve 110 is represented by the area under the solid curve in FIG. 3. The high speed counter 154 keeps data relating to the accumulated volume being discharge as it receives corresponding pulses from the respective flow meters 140*a-d*. T3, i.e. the time for starting the closing sequence, is determined by comparing the discharged volume with a reference value corresponding to the desired volume. The volume being discharged during the closing sequence, i.e. the volume being discharged between T3 and T4 and represented by the shadowed area under the solid curve, is estimated for setting T3 correctly such that the total volume being discharged from the filling valve 110, i.e. the total volume being measured by the associated flow meter 140 for each filling sequence, is equal to, or very close to, the desired filling volume.

Again referring to FIG. 2, the controller 150 is further connected to a pressure sensor 125 which is arranged at the liquid product supply 120. The pressure sensor 125 is thus configured to measure the pressure of the liquid product entering the respective filling valve 110*a-d*. As the filling speed for each filling valve 110 is dependent on the upstream liquid pressure the actual flow speed may vary slightly during production. The associated flow meter 140 will ensure that closing of the filling valve 110 is initiated not at a specific time, but when the discharged volume equals the desired filling volume minus the estimated volume during the closing sequence (i.e. the volume being discharged between T3 and T4 of FIG. 3).

However, also flow speed during the closing sequence will vary slightly depending on the actual upstream pressure. Therefore, the central processing unit 152 is configured to calculate an estimated value of the discharge volume during the closing sequence, wherein the estimated value corresponds to a filling valve specific value being compensated by the upstream pressure. Hence, by receiving the actual upstream pressure the central processing unit 152 is configured to determine the volume which will be discharged during closing of the filling valve 110 for the actual upstream pressure, whereby the closing command, which is initiated by the high speed counter 154, is transmitted to the filling valve 110 after a specific number of received flow meter pulses. The specific number of flow meter pulses thus corresponds to the number of pulses corresponding to the desired filling volume minus the number of pulses corresponding to the discharge volume during the closing sequence.

Returning to FIG. 3 the controller 150 is thus configured to automatically control the closing sequence by calculating the expected discharge volume during the closing sequence, which expected discharge volume depends on the upstream pressure, and by transmitting the closing command when the accumulated discharge volume equals the desired volume minus the expected discharge volume during the closing sequence.

Figure 4:
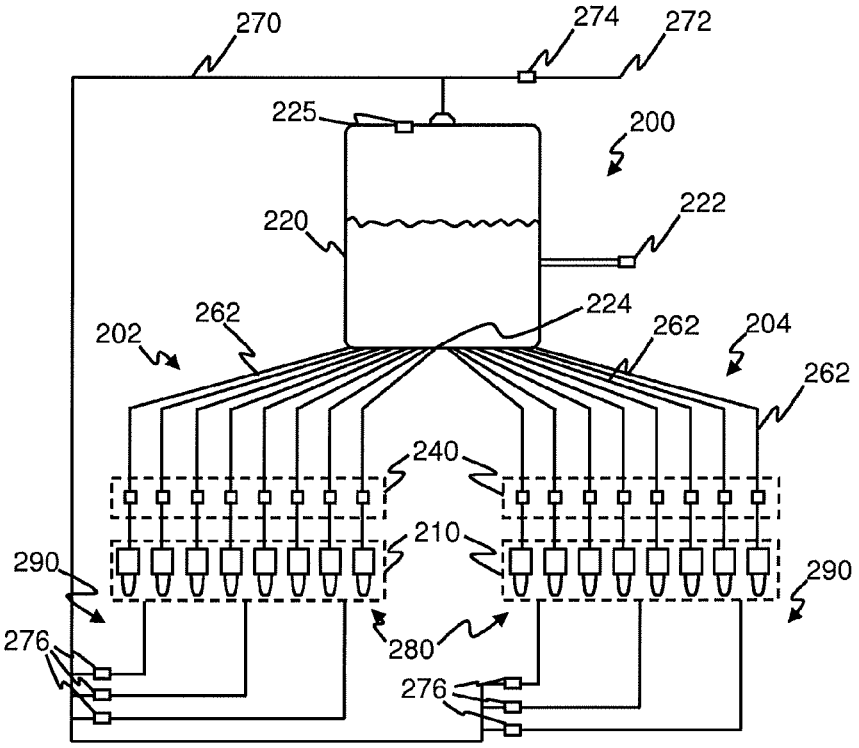
FIG. 4 is a schematic view of a filling valve system according to a further embodiment.

Now turning to FIG. 4 an embodiment of a filling valve system 200 is shown. The filling valve system 200 is preferably implemented in a filling machine used for producing so called carton bottles, i.e. liquid food packages having a carton based sleeve closed by a plastic top, and which filling machine is commercially available by Tetra Pak® under the trademark A6 iLine™.

For this high-speed machine, allowing production of up to 10,000 packages per hour, pre-sterilized semi-finished packages are entering the filling valve system 200. The filling valve system 200 includes two separate filling lines 202, 204, wherein each filling line 202, 204 comprises eight filling valves 210 arranged in parallel and configured to be operated in partial sequence as will be described below.

A liquid product tank 220 enclosing liquid product is provided upstream of the filling valves 210 and comprises a liquid product inlet 222 for controlling the liquid level within the liquid product tank 220. The liquid product tank 220 further comprises liquid product outlets 224 being in fluid communication with a plurality of liquid product fluid channels 262. Each fluid channel 262 ends with an associated filling valve 210. Further, each fluid channel 262 is equipped with a flow meter 240 arranged upstream of the filling valve 210.

The filling valve system 200 further comprises a gas system 270 which includes a gas supply 272. The gas, which preferably is either sterilized air or nitrogen, flows into the liquid product tank 220 and the flow is regulated by means of a control valve 274 being arranged between the gas supply 272 and the liquid product tank 220. Hence, the gas supply 270 is thus configured to provide a controlled environment within the liquid product tank 220.

The gas system 270 further extends to one or more control valves 276, wherein said control valves 276 are arranged in two sets of control valves. Each set of control valves 276 is configured to control a gas flow to each filling line 202, 204. As indicated in FIG. 4, each set of control valves 276 allow gas to flow into a specific area 280 being associated with a corresponding filling line 202, 204. During production, the control valves 276 ensure that a controlled environment is maintained at the location of the filling valves 210 where a corresponding package is to be filled (not shown) for preventing microorganisms and other unwanted substances to enter and contaminate the interior of the package as well as the liquid product itself.

In a preferred embodiment, as is illustrated in FIG. 4, each set of control valves 276 are allowing gas to flow into the respective area 280 of each filling line 202, 204. For example, three control valves 276 for each filling line 202, 204 have been proven to be an efficient way of controlling the gas flow to the respective areas 280. However, in other embodiments only one control valve 276 may be provided for each filling line 202, 204.

A controller (not shown) is further provided and connected to the filling valves 210 and the flow meters 240 in the same manner as already being described with reference to FIG. 2. In general, the controller associated with the embodiment of FIG. 4 is essentially identical to the controller 150 described with reference to the embodiment shown in FIG. 2, i.e. the controller comprises a central processing unit and a high speed counter. The controller of the present embodiment is connected to a pressure sensor 225 arranged inside the liquid product tank 220 for measuring the gaseous pressure within the liquid product tank 220. The controller may also be configured to control the operation of the gas system 270, although an additional controller may be provided for this purpose.

For the embodiment shown in FIG. 4, the flow speed in each fluid channel 262 depends on the gaseous pressure inside the liquid product tank 220. By measuring the gaseous pressure inside the liquid product tank 220 it is possible to calculate an estimated discharge volume during the closing sequence, which estimated discharge volume depends on the gaseous pressure inside the liquid product tank 220.

Now turning to the operation of the filling valve system 200 packages are fed to the first filling line 202, the second filling line 204, or both.

Starting with high speed production, both filling lines 202, 204 are controlled to be in operation and the associated filling valves 210 are commanded to be in an active state. Two packages are fed to each filling line 202, 204 thus occupying the two foremost filling valves 210 in each filling line 202, 204. The gas system 270 provides a flow of gas into the areas 280 of the filling valves 210 by opening of the control valves 276. The controller then initiates opening of the two foremost filling valves 210 of each filling line 202, 204 whereby liquid product is started to be discharged from the fluid channels 262 being in communication with the liquid product tank 220. The controller receives at least one value representing the actual gas pressure within the liquid product tank 220 from the pressure sensor 225, as well as the actual volume of liquid product exiting the filling valves 210 from the associated flow meters 240. Depending on the actual gas pressure the controller determines an estimated discharge volume during the closing sequence, and initiates closing of the filling valves 210 when the discharged volume equals the desired volume minus the estimated volume for closing.

Once closing of the filling valves 210 is fulfilled the packages occupying the area at the two foremost filling valves 210 of each filling line 202, 204 are transported to the subsequent two filling valves 210 at the same time as two new packages are moved into the position of the two foremost filling valves 210 of each filling line 202, 204. The controller initiates closing of the filling valves 210 for each open filling valve 210 depending on the actual pressure within the liquid product tank 220.

Each package will thus be subjected to four filling steps, wherein each step is performed by an associated filling valve 210 at a specific area 280 of gaseous supply. With reference to only one of the two filling lines 202, 204, when the first two packages are arranged in the fourth (and last) filling step all filling valves 210 are in operation with associated packages. Once two packages are filled accordingly, they will proceed into a sealing station in which the still open end of the packages will be sealed and formed.

In some cases, e.g. during partial service or maintenance or during slower production only one of the two filling lines 202, 204 are in operation. Hence, one set of filling lines 210 associated with one of the filling lines 202, 204 is commanded in a non-active state, and the control valves 276 associated with that particular filling line 202, 204 are closed. This will induce a slight change in the gas pressure inside the liquid product tank 220 which is detected by the pressure sensor 225. Consequently, as such pressure change will cause a change in the flow speed in the fluid channels 262, the accumulated discharge volume at which closing of the filling valves 210 is initiated may be adjusted thus resulting in an accurate filling volume according to a predetermined volume.

Figure 5:
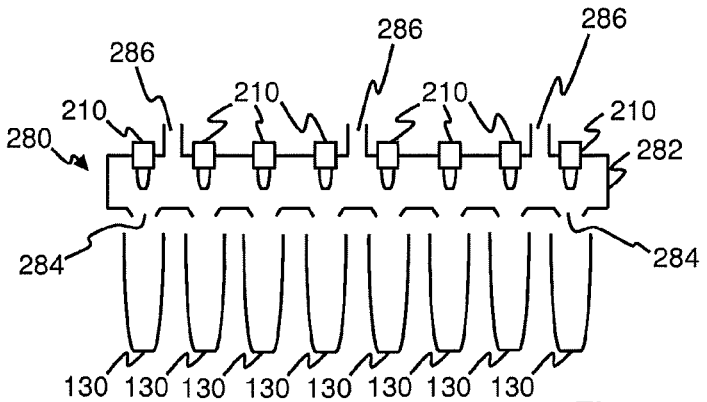
FIG. 5 is a schematic view of a part of a filling valve system according to an embodiment.

One embodiment of the area 280 is shown in FIG. 5. The area 280, illustrated for a single filling line 202 only, includes a housing 282 which surrounds the outlets of the filling valves 210. The housing 282 comprises a plurality of outlets 284, wherein the exact number corresponds to the number of filling valves 210. Hence, when a filling valve 210 is opened liquid product will be discharged into the housing 282 and exits the housing 282 at a specific outlet 284. The housing 282 further comprises a number of gas inlets 286, wherein each gas inlet 286 is in fluid communication with a control valve 276 (see FIG. 4). The gas system 270 thus allows a flow of gas into an area 280 of the filling valves 210 such that the liquid product being discharged is always enclosed by a controlled environment formed by a regulated gas flow. Since the gas will also escape from the housing 282 at the outlets 284, the packages 130 being aligned with the outlets 284 will also be exposed to the controlled environment.

Figure 6:
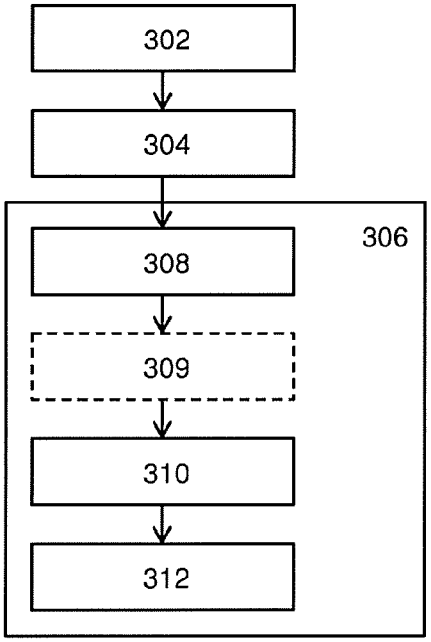
FIG. 6 is a schematic view of a method for a filling valve according to an embodiment.

Now turning to FIG. 6, an embodiment of a filling method 300 will be described. The method 300 is provided in order to allow a predetermined volume of liquid product discharge into individual packages and the method 300 comprises a first step 302 of controlling the opening of the filling valve for allowing liquid product discharge at a starting time. During step 304, which is initiated at the same time as the first step 302, the method 300 measures the amount of liquid being discharged through the filling valve by means of a flow meter or any other sensor being capable of determining the amount of liquid passing it. The method further comprises the step 306 of controlling the closing of the filling valve at a specific accumulated discharge volume for initiating the filling valve to close. Step 306 is preferably performed by several sub-steps, comprising a step 308 in which the pressure of the liquid product upstream of said filling valve is determined, a step 310 in which an estimated discharge volume during closing of the filling valve based on said determined pressure is calculated, and a step 312 in which said closing time based on said estimated discharge volume is adjusted.

Between step 308 and step 310 an optional step 309 may be performed, in which the determined pressure is compared with a reference pressure for determining a pressure difference, and wherein said estimated discharge volume is calculated based on said pressure difference. In a further embodiment, step 310 may be performed such that the determined pressure is used for retrieving an estimated filling volume during the closing of the filling valve, whereby the closing sequence is initiated when the measured amount of liquid product being discharged equals the desired volume minus the estimated filling volume during closing of the filling valve.

The method 300 is preferably implemented in a filling machine for providing individual packages with liquid food content, which machine operates by discharging volumes of liquid product through individual filling valves, and wherein the liquid product supply is a liquid product tank being pressurized by a gaseous media. Hence, the method 300 may provide high accuracy in the discharged volume even when the pressure inside the liquid product tank varies, which variations otherwise would lead to a small deviations in the discharged volume.

Although the above description has been made mostly with reference to a filling valve system used for filling machines within liquid food technologies wherein the liquid food is filled into individual packages, it should be readily understood that the general principle of the method and device is applicable for various different technical fields in which filling of liquid products is accomplished by filling valves.

Further, the invention has mainly been described with reference to a few embodiments. However, as is readily understood by a person skilled in the art, other embodiments than the ones disclosed above are equally possible within the scope of the invention, as defined by the appended claims.

The invention claimed is:

1. A filling valve system configured to discharge a predetermined volume of liquid product to individual packages, said system comprising:

at least one filling valve;

a controller configured to open said at least one filling valve thus allowing liquid product to be discharged and configured to close said at least one filling valve;

a flow meter configured to measure the amount of liquid product being discharged through said at least one filling valve; and a pressure sensor configured to determine a pressure upstream of said at least one filling valve, wherein said controller is further configured to calculate an estimated discharge volume during a closing sequence of said at least one filling valve based on the determined pressure, and to initiate said closing sequence based on said estimated discharge volume;

wherein said controller is configured to compare said determined pressure with a reference pressure for determining a pressure difference, and wherein said estimated discharge volume is calculated based on said pressure difference.

2. The system according to claim 1, comprising a gas system in fluid connection with a liquid product tank, which liquid product tank is arranged in fluid connection with said at least one filling valve.

3. The system according to claim 2, wherein said pressure sensor is arranged inside said liquid product tank and configured to determine a gaseous pressure inside said liquid product tank.

4. The system according to claim 3, wherein said gas system is in fluid connection with an area adjacent to said at least one filling valve for providing a gaseous environment at said area.

5. The system according to claim 4, wherein said at least one filling valve comprises a first set of filling valves associated with a first filling line and a second set of filling valves associated with a second filling line, wherein each one of said sets of filling valves are configured to be in an active state or in a non-active state independent of each other, and wherein said gas system is providing a gaseous environment only to the set of filling valves being in an active state.

6. The system according to claim 3, wherein said gas system comprises a supply of air or nitrogen gas.

7. A filling machine for filling liquid products into individual packages, comprising a filling valve system according to claim 1.

8. The filling machine according to claim 7, wherein said filling valve system is arranged in an aseptic area of said filling machine.

9. A method for a filling valve being configured to discharge a predetermined volume of liquid product to individual packages, comprising:

controlling the opening of the filling valve for allowing liquid product discharge at a starting time, measuring the amount of liquid being discharged through the filling valve, and controlling the closing of the filling valve by:

i) determining a pressure upstream of said filling valve, ii) calculating an estimated discharge volume during a closing sequence of the filling valve based on said determined pressure, and iii) initiating a closing sequence based on said estimated discharge volume;

wherein the controlling of the closing of the filling valve further comprises comparing said determined pressure with a reference pressure for determining a pressure difference, and wherein said estimated discharge volume is calculated based on said pressure difference.

10. The method according to claim 9, wherein the determining of the pressure upstream of the filling valve comprises determining the pressure in a liquid product tank being in fluid connection with said filling valve.

11. A filling valve system configured to discharge a predetermined volume of liquid product to individual packages, the system comprising:

at least one filling valve through which the liquid product is discharged into the individual packages during operation of the system;

a liquid product source connected to the at least one filling valve and configured to supply the liquid product to the at least one filling valve, wherein the liquid product source is a tank configured to contain the liquid product;

a controller operatively connected to the at least one filling valve to change the at least one filling valve between an open position in which the at least one filling valve permits discharge of the liquid product into one of the individual packages and a closed position in which the at least one filling valve prevents discharge of the liquid product into one of the individual packages;

a flow meter associated with the at least one filling valve and configured to measure an amount of the liquid product being discharged through the at least one filling valve;

a pressure sensor arranged at the liquid product source to measure pressure of the liquid product at a location upstream of the at least one filling valve;

a gas system fluidly connected to the tank, the at least one filling valve comprising a first set of filling valves associated with a first filling line and a second set of filling valves associated with a second filling line, each one of the sets of filling valves being configured to be in an active state or in a non-active state independent of each other, and the gas system providing a gaseous environment only to the set of filling valves in an active state; and the controller being operatively connected to the pressure sensor to receive information about the pressure of the liquid product at a location upstream of the at least one filling valve, to calculate using the measured pressure an estimated discharge volume of the liquid product that will be discharged from the at least one filling valve during a closing sequence of the at least one filling valve when the at least one filling valve is moving from the open position to the closed position, and to initiate the closing sequence based on the calculated estimated discharge volume.

12. The system according to claim 11, wherein the controller compares the measured pressure with a reference pressure to determine a pressure difference, and calculates the estimated discharge volume using the pressure difference.

13. The system according to claim 11, wherein the pressure sensor is positioned inside the tank and determines a gaseous pressure inside the tank.

14. The system according to claim 11, wherein the first set of filling valves comprises a plurality of filing valves arranged adjacent one another.

* * * * *